US005632859A

United States Patent [19]

Heitto et al.

[11] Patent Number: 5,632,859

[45] Date of Patent: May 27, 1997

[54] INTERGRAL PULP MILL AND METHOD OF CONSTRUCTING AN INTEGRAL MILL

[75] Inventors: Pertti Heitto, Espoo; Vesa Junttila, Kouvola; Erkki Kiiskilä, Karhula; Tarmo Sulander, Kauniainen, all of Finland

[73] Assignee: Ahlstrom Machinery Oy, Helsinki, Finland

[21] Appl. No.: 710,071

[22] Filed: Jun. 4, 1991

[30] Foreign Application Priority Data

Jun. 7, 1990 [FI] Finland ..... 902857

[51] Int. Cl.[6] ..... D21C 7/12; D21F 7/06

[52] U.S. Cl. ..... 162/49; 162/61; 162/62; 162/198; 162/238; 162/246; 162/253

[58] Field of Search ..... 162/52, 246, 238, 162/49, 62, 253, 198, 61; 901/7; 414/222, 225

[56] References Cited

U.S. PATENT DOCUMENTS

| | | | |
|---|---|---|---|
| 4,543,702 | 10/1985 | Wada | 901/7 |
| 4,674,181 | 6/1987 | Hamada et al. | 901/7 |
| 4,685,850 | 8/1987 | Ohta et al. | 901/7 |
| 4,740,133 | 4/1988 | Kawano | 901/7 |
| 4,985,722 | 1/1991 | Ushijima | 414/225 |

FOREIGN PATENT DOCUMENTS

| | | |
|---|---|---|
| 0357473 | 3/1990 | European Pat. Off. . |
| 304825 | 1/1973 | Germany . |

OTHER PUBLICATIONS

Snook, *Handbook For Pulp & Paper Technologists*, pp. 173–178 (Joint Executive Committee of the Vocational Education Committees of the Pulp and Paper Industry, Canada 1989).

*Primary Examiner*—Steven Alvo

*Attorney, Agent, or Firm*—Cohen, Pontani, Lieberman, Pavane

[57] ABSTRACT

A mill for the processing and production of wood pulp is contained substantially entirely within a single, integral structure that defines a unitarily-covered space substantially bounding and enclosing the mill. The mill includes a main control room or station for overall monitoring and control of pulp processing operations in the mill, the main control station being disposed substantially centrally within the covered space, and a plurality of processing stations at which various pulp processing operations take place in a generally sequential manner or order. The plural processing stations are disposed within the covered space and radially outwardly from the main control station, with individual ones of the processing stations being arranged and located in the covered space relative to others of the processing stations so that as the pulp undergoes the sequential processing operations at the plural processing stations the pulp proceeds substantially circumferentially about the main control station between and among the individual processing stations.

17 Claims, 4 Drawing Sheets

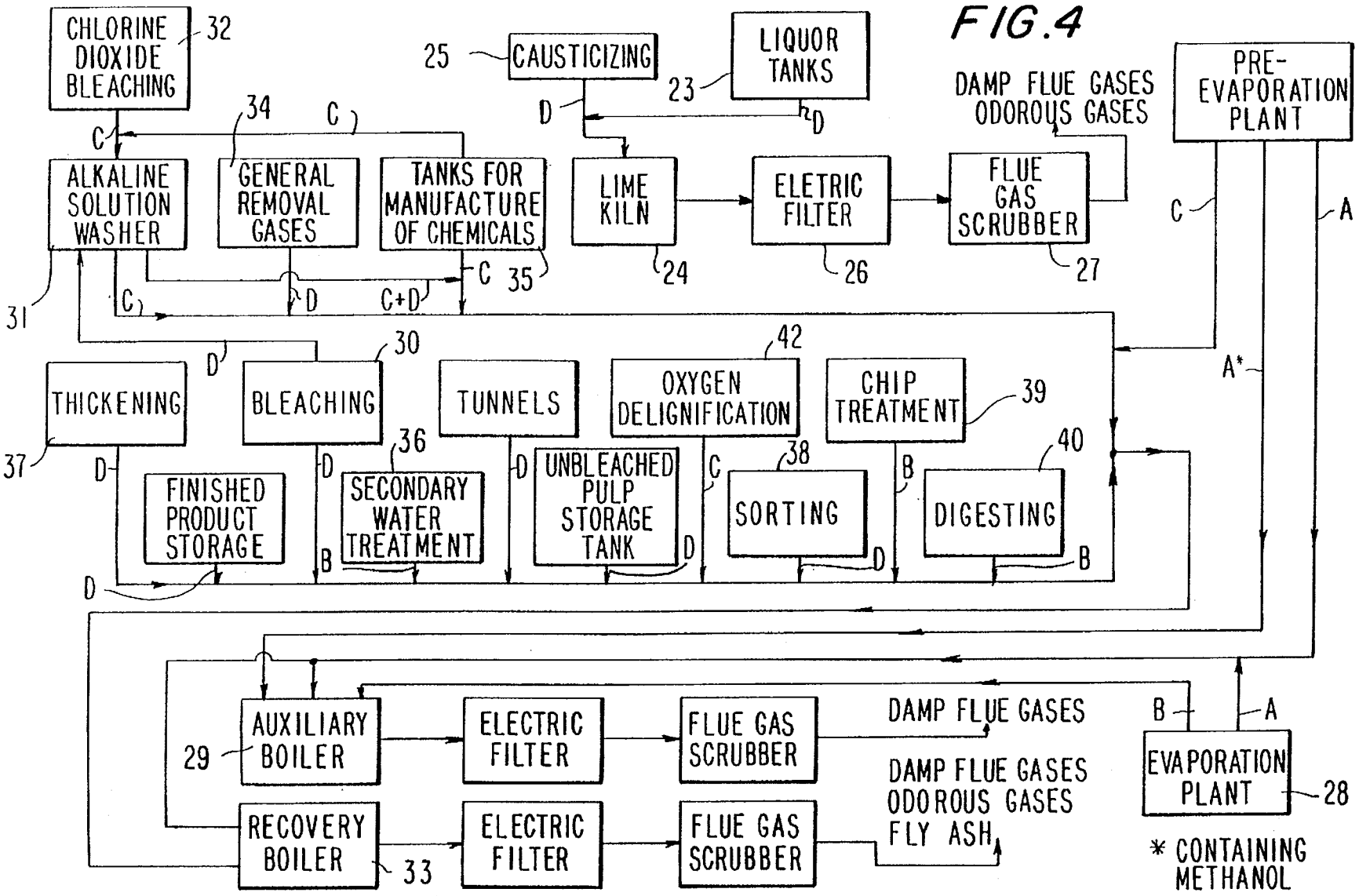
PRE-EVAPORATION PLANT
A
A*
C
EVAPORATION PLANT
28
B
* CONTAINING METHANOL
DAMP FLUE GASES
ODOROUS GASES
FLUE GAS SCRUBBER
27
DIGESTING
40
B
CHIP TREATMENT
39
B
SORTING
38
D
DAMP FLUE GASES
DAMP FLUE GASES
ODOROUS GASES
FLY ASH
LIQUOR TANKS
23
D
ELETRIC FILTER
26
OXYGEN DELIGNIFICATION
42
C
UNBLEACHED PULP STORAGE TANK
D
FLUE GAS SCRUBBER
FLUE GAS SCRUBBER
CAUSTICIZING
25
D
LIME KILN
24
TUNNELS
D
ELECTRIC FILTER
ELECTRIC FILTER
TANKS FOR MANUFACTURE OF CHEMICALS
35
C
C+D
SECONDARY WATER TREATMENT
36
B
BLEACHING
30
D
AUXILIARY BOILER
29
RECOVERY BOILER
33
GENERAL REMOVAL GASES
34
C
D
FINISHED PRODUCT STORAGE
D
CHLORINE DIOXIDE BLEACHING
32
C
ALKALINE SOLUTION WASHER
31
C
THICKENING
37
D
D
FIG. 4

INTERGRAL PULP MILL AND METHOD OF CONSTRUCTING AN INTEGRAL MILL

FIELD OF THE INVENTION

The present invention relates to a production plant and a method of constructing the same, such as and most especially a pulp mill, for treating material that moves or flows through the plant as, for example, through a series or multiplicity of processes or subprocesses, such production plants typically including one or more control rooms and a plurality of separate processing or production sections or stations.

BACKGROUND OF THE INVENTION

Conventionally-known large production or processing plants, such by way of specific example as wood pulp mills and the like, are generally constructed as a multiplicity of separate buildings or structures, each housing at least one processing or production section or station. The main processing section and a main control room, if any, are normally located or associated so as to form a single unit, i.e. the main line of the plant. Production sections where auxiliary operations and/or subprocesses are carried out or take place are then disposed along the main line, often on or along both sides thereof. Since the various production sections are typically located in separate buildings, each of them forming a discrete or generally self-contained entity, they are normally provided with their own control rooms even though information on these auxiliary operations or subprocesses may be transmitted to a remotely-located main control room. Yet irrespective of the appropriateness of the manner in which the various subprocess buildings are laid out or arranged in accordance with the production process flow, these separate processing sections are nevertheless physically spaced apart and scattered, requiring relatively long transfer pipings and conduits and the like for communicating the products or subproducts and byproducts of the ongoing process between the various subprocess stations and/or the main line. Thus, when utilizing these known prior art layouts and control systems the construction times for new production plants or mills are unusually long and the associated construction costs are extremely high.

OBJECTS AND SUMMARY OF THE INVENTION

It is accordingly an object of the present invention to provide a materials processing or production plant—and most particularly a pulp mill—which, in use, enables the beneficial realization of improved annual production stability, substantially lowered environmental load by virtue of centralized overall control and treatment of emissions to the atmosphere, ground and waters, increased economies in the consumption and use of energy, decreased investment requirements for planning and construction, and notably decreased size (i.e. total area) and shortened construction time as compared to prior art production plants.

These and additional objects of the invention are realized in accordance with the invention in a pulp mill production plant arranged such that the main control room is disposed substantially centrally with respect to circumferentially-outlying subprocessing or production stations or sections, the production sections being located primarily in a sector-like manner about the main control room, and wherein the flow or movement or operative advancement of pulp and/or other materials that are the subject of the plant's processing or production principally proceeds circumferentially and generally sequentially between adjacently-disposed production sections. The various individual production sections or stations are preferably, and primarily, disposed within a single integrated, covered space or structure or building.

A wood pulp mill is a type of production plant that includes a plurality of separate processing sections or stations and wherein a multiplicity of different liquor, mass and gas flows are respectively transferred, treated and controlled in a generally sequential manner. Thus, the present invention is primarily directed to, and will hereinafter be described in the context of, such a pulp mill. It should, nevertheless, be recognized and understood that the present invention may have even broader and more general utility and applicability and may, therefore, also be adapted to a large variety of processes and environments in addition to the expressly-described plant for the processing and treatment of pulp which, nevertheless, is the principal intended subject matter of the invention.

A pulp mill production plant constructed in accordance with the teachings of the present invention may be employed in installations of virtually any size and for accommodating a wide range of processing or production volumes. Thus, the available or accommodatable production volume of the plant may be increased or decreased, as a function of specification or need, by merely varying the general, overall dimensions of the pulp mill while the basic shape and arrangement, as herein disclosed, remain substantially unchanged. Moreover, the pulp mill of the invention may be formed of standard components so that the border or processing areas or sections or stations are easier to design and implement as compared with currently-employed mill arrangements. As a consequence, the planning and design of pulp mills of a wide range of different production volumes and capacities, in accordance with the instant invention, takes a significantly shorter time than is now the case with present custom-designed and constructed pulp mills.

When new pulp mills are currently constructed using the layouts and control systems of conventional technology, the construction times and delays are long and the associated construction costs are high. Use of the teachings and arrangement of the present invention, on the other hand, effects a reduction of the total area of the resulting pulp mill to approximately one-fifth of the total area of conventional pulp mills that are capable of handling the same production volume. As a consequence, it is far easier to locate optimum or acceptable geographic locations, insofar as the requirements for mill operation and the effect on its surroundings, for pulp mills constructed in accordance with the present invention than for prior art mills. And since the various production sections or stations are primarily disposed within a single covered unit or building, instead of in a multiplicity of separate buildings as is taught by the prior art, the costs of construction and of transport are considerably reduced. The savings in construction costs alone of such a pulp mill arranged in accordance with the present invention amount to approximately 30 to 50 percent as compared to currently-known mill arrangements.

The production or processing sections or stations of the inventive pulp mill are preferably located so as to generally minimize or reduce the distances along which the liquor, mass and/or gas is or need be operatively transported. In addition, it should be recognized that a complete, modem sulphate pulp mill typically includes over 300 different types of pumping operations—many of which relate to the movement of liquor, mass and/or gas among or between the various processing sections or stages—and that the power consumption of the pumps and fans of these operations in such a mill amounts to approximately two-thirds of the total power consumption of the entire plant. Thus, a reduction in the pumping requirements of the mill can provide significant savings in the use of electric power. Notably reduced pumping requirements—and the resultant energy savings—are yet another noteworthy feature and attribute of the present invention.

More particularly, in accordance with the invention the individual processing sections or stations are located in a sector-like manner circumferentially about the centrally-disposed main control room. Moreover, these processing stations are arranged so that the flow of the materials or articles which the plant processes—i.e. the wood chips or pulp—proceeds generally circumferentially between substantially adjacently-disposed ones of the processing stations. This advantageous arrangement significantly minimizes the length of pipings and conduits and transport paths from station to station, thereby reducing or eliminating prolonged delays in the effectiveness of ongoing process adjustments and potentially increasing the overall or composite rate of materials processing from, for example, start to finish. The reduction in length of interprocess pipes and conduits also reduces the likelihood and incidence of leaks occurring along such flow paths. And the shorter travel distances between successive processing stations or sections reduces the pump capacities and number of pump units required to transport the liquor, mass and/or gas throughout the sequential materials processing operation. The present invention thus optimizes the arrangement of the various separate and individual processing sections or stages circumferentially about the substantially centrally-disposed main control room to maximize these and other resulting benefits. Savings in respect of pipings and cables of approximately 40 to 60 percent over prior art production plant constructions are thereby achievable in accordance with the invention.

When production control in even newly-constructed pulp mills is based on the layouts and control systems of conventional mill technology—i.e. in accordance with the prior art—the duration curve of pulp production is unstable. In other words, the volumetric production of pulp on any given day during an extended period of time, such as a year, of operation will significantly vary and fluctuate from the average production for that period, with such fluctuations being extremely unpredictable and preventing reasonably effective prediction or forecasting of the anticipated production for an upcoming period of time. The arrangement of the present invention, on the other hand, provides significantly enhanced process control by virtue of its novel layout and arrangement and, as a consequence, the annual duration curve of mill production is notably stabilized and improved and the production yield of the mill is correspondingly increased.

Maintenance of a pulp mill constructed in accordance with the invention is also easier and less frequently required than in prior art arrangements because the centrally-located main control room enables direct viewing of many or all of the circumferentially-disposed processing stations and, in addition, because of the notably reduced lengths of transport pipings and conduits and paths and the placement of substantially all parts and sections and stations of the entire pulp mill under a single roof or covered enclosure. Moreover, maintenance operations and procedures may be carried out with enhanced safety and convenience in a unitarily covered space. Thus, by way of example, wintertime maintenance and repair services in areas between successive or otherwise separate production sections is substantially easier in a pulp mill of the present invention since the workers need not be exposed to snow or other inclement or unpleasant weather that can interfere with or prevent completion of necessary maintenance procedures. The centralized arrangement of the present invention enables maintenance to be available and performed approximately 40 to 50 percent sooner than in prior art plants and can permit reductions of approximately 20 to 50 percent in the number of currently-required operating personnel.

Current pulp mills use, in operation, a great deal of water—i.e. approximately 40 to 130 $m^3$/pulp-ton; the plant layout and manner of circulation of water in the processing of pulp, as presently implemented, greatly contribute to unnecessary consumption of water. For example, flushing over several acres of asphalted areas between the various distinct production sections and buildings of prior art pulp mills consumes and wastes large quantities of water. These flush waters also carry with them partly or totally uncleaned chemical/pulp suspensions that are thereby discharged into the environment.

The arrangement of the present invention, on the other hand, provides an optimized layout and rationalized reconsumption of process liquors, i.e. a completely and generally unitarily covered processing environment with centralized control and integrated treatment of all manner of process liquors from the production and process. This beneficially enables a reduction in water consumption to approximately 15 to 20 $m^3$/pulp-ton—a reduction of as much as 85 percent or more.

Another advantageous feature of the present invention is the provision of an integrated or centralized air treatment system. Partition walls may be constructed between some or all of the individual production sections where necessary or appropriate, for example, to confine or minimize the escape of noise or harmful emissions produced in certain stages of the production process. Thus, the air in such an isolated area may be controlled and treated more efficiently than is the air in relatively cleaner areas of the mill, and the exhaust air from such cleaner areas may be utilized, at least in part, as return air.

In further accordance with the invention, centralized means for controlling and for filtering, as well as for heat recovery, may be provided in connection with the treatment of combustible gases and other gaseous emissions that can result from the various processes to which the materials being processed in a pulp mill are subjected. Such an arrangement also provides increased ability and potential for minimizing or eliminating harmful and annoying odors than is now realized in current installations.

In addition, all waste waters of the pulp mill, including floor flushing waters, and solid wastes of the pulp treatment process are controlled and treated in a centralized manner.

As previously pointed out hereinabove, the novel arrangement of the present invention notably and significantly reduces the investment costs associated with the planning and construction of such production plants, whereby the resulting savings may be used for environmental features and investment without affecting the competitiveness of the resulting plant. The inventive arrangement also reduces the power consumption of the plant or mill to a great extent, further enabling the implementation of radical solutions of serious environmental problems. For example, evaporation can be used to prevent dioxins from entering waste waters and polluting the environment. The centralized control and treatment of water and air emissions, as described hereinabove, and the reduced water consumption of the inventive arrangement, further result in a significant lessening of toxic emissions per product unit.

As compared with presently known and used arrangements, the total power consumption is reduced by about 10 to 30 percent in a typical pulp mill constructed in accordance with the invention.

A pulp mill producing fully bleached market pulp is composed of about twenty sections or stations operating on a variety of different principles. Chemically and physically different sections should, preferably, cooperate efficiently. In present pulp mills, the individual process sections are located far from one other in separate buildings; as a result, fluctuations in subprocess parameters or operations or the like cannot be effectively or efficiently controlled. Moreover, abrupt and uncontrolled fluctuations in these subprocesses significantly add to the volume and incidence of harmful emissions from the mill. In the arrangement of the instant invention, on the other hand, such fluctuations are far better controlled by virtue of the provision of centralized or integrated control systems, the ready availability of maintenance procedures, rapid operational adjustability of the various processes due to relatively short transport pipings and inter-processing distances, and centralized systems for the treatment of emissions.

Since the main control room is disposed centrally, or at least substantially centrally, with respect to the individual production or processing sections which are located in a generally circumferential sector-like manner about the main control room, the operations of these individual processing sections may be followed and monitored in the main control room both on the basis of measured data and real-time instrumentation and the like as well as by direct viewing of the various processing stations located radially-outwardly thereabout. Based on the information so viewed and received, the main control room can readily and efficiently control the operations of the entire pulp mill in a convenient and centralized manner.

In a preferred arrangement in accordance with the invention, centralized treatment of incoming and outgoing or departing materials or goods takes place in a specific transport area that is controllable from the main control room. This centralized goods treatment system includes transportation lanes or paths to and from the production plant, a main control room, and an operable crane system. Incoming goods or materials are unloaded within the integrated covered area within which substantially the entire plant is housed. The transfer of goods and materials within the mill may be effected by means of a crane system located substantially centrally within the transport area and along at least a diameter of the unitary mill building or structure. By virtue of this arrangement, goods may be readily and conveniently unloaded, as for example from railway carriages or other vehicles, and then transferred to specific processing sections or stations or from one processing station to another.

The processing stations or sections of the pulp mill may, by way of preferred example, together define an area having the general shape of a full circle or oval, or of a polygon, or of a portion of a circle or oval or polygon. Thus, where the pulp mill is integrated with a paper mill, the paper mill may be advantageously connected with and disposed relative to the pulp mill so that the processing sections of the pulp mill cover one portion of the plant circumference and the paper mill covers another portion or the remainder of the circumference, the paper mill being joined to the pulp mill at that point along the circumference at which the pulp drying section would begin.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims.

BRIEF DESCRIPTION OF DRAWINGS

In the drawings, wherein similar reference characters denote similar elements throughout the several views:

FIG. 4 is a block diagram flow chart of an integrated system for processing the various odorous gases in a pulp mill in accordance with the invention.

DETAILED DESCRIPTION OF THE PREFERRED EMBODIMENT

Figure 1:
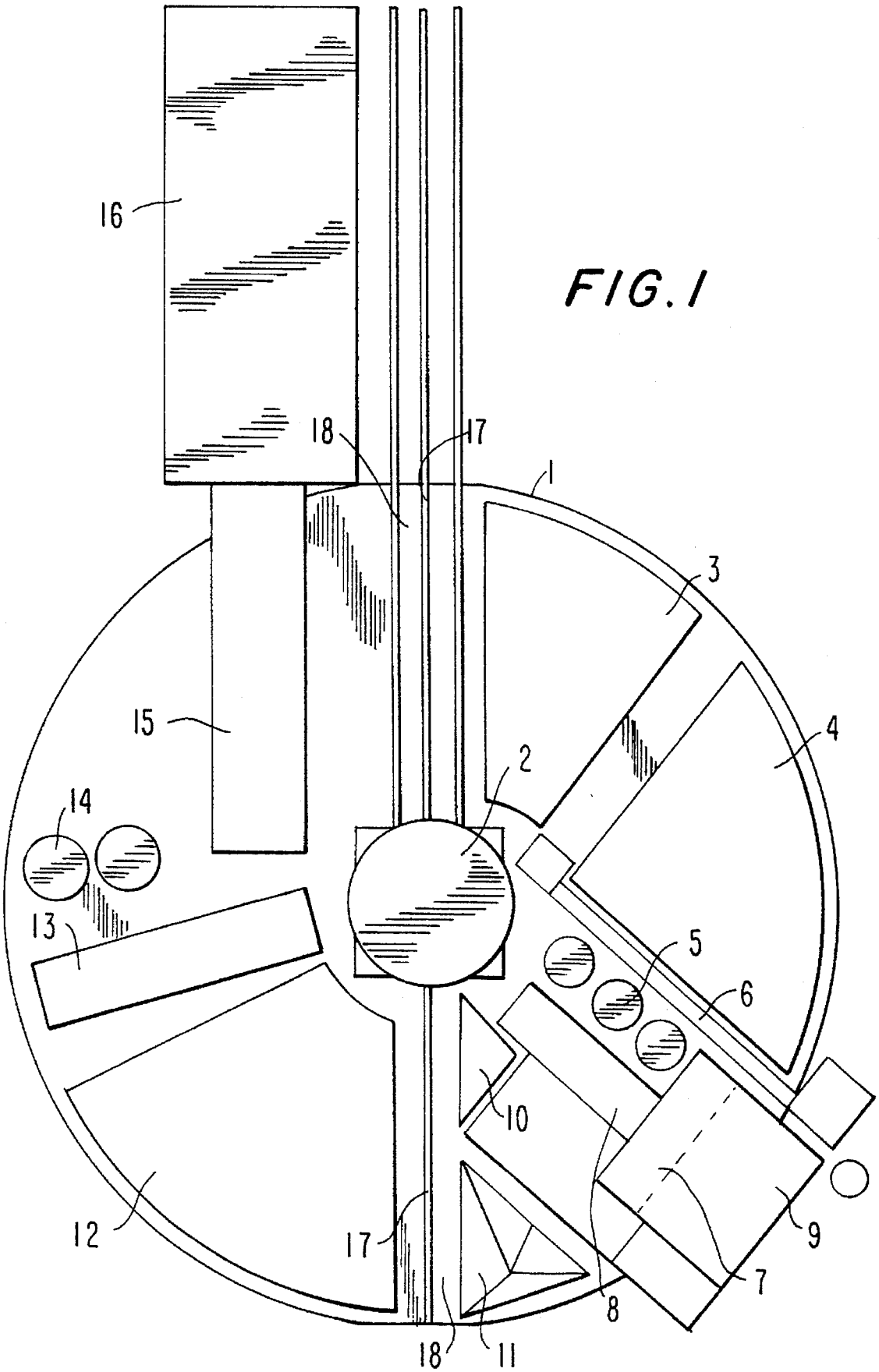
FIG. 1 is a sectional plan view of a pulp mill, including a plurality of production or processing stations, a centralized main control room and a materials transport system, constructed in accordance with the present invention.
Figure 2:
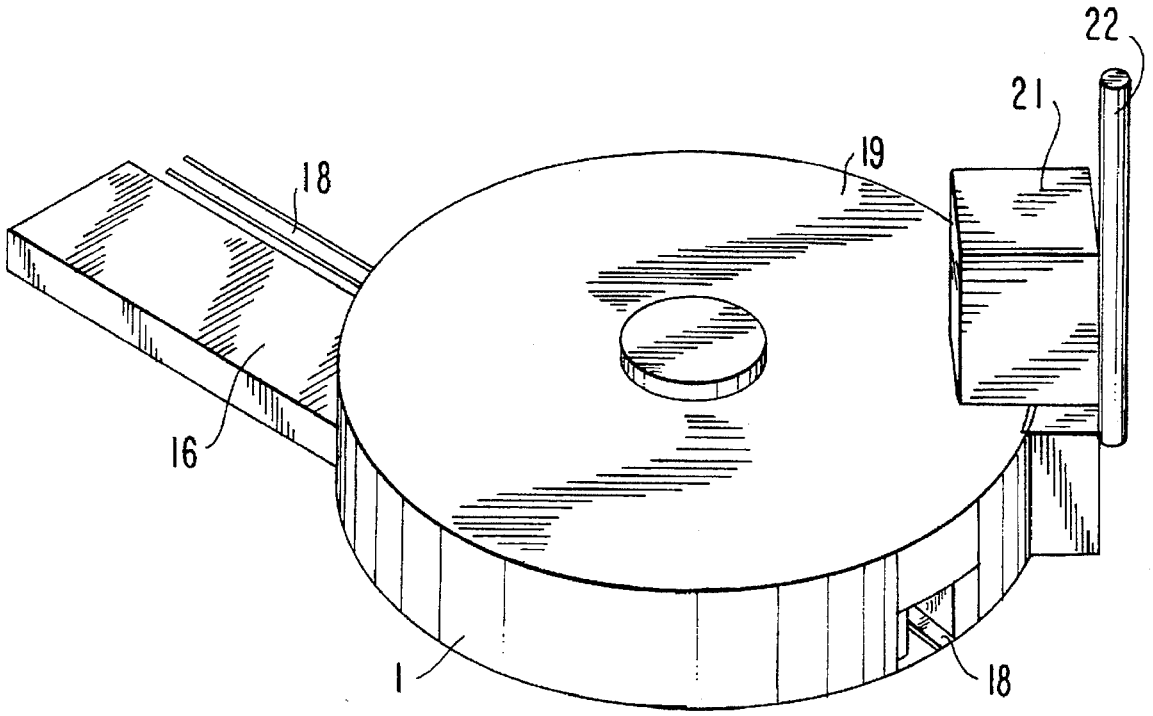
FIG. 2 is an elevated exterior perspective of the pulp mill of FIG. 1.
Figure 3:
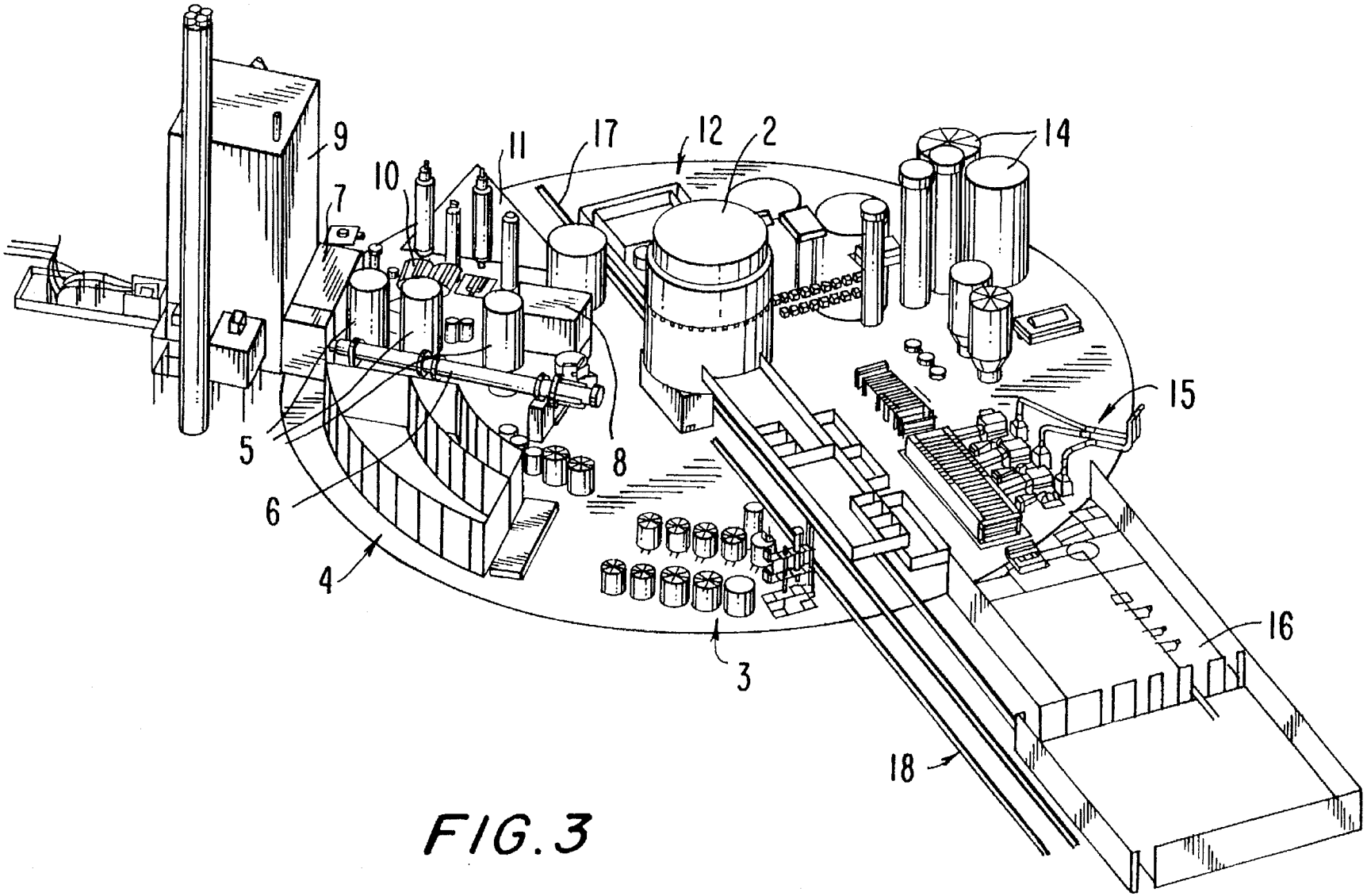
FIG. 3 is an elevated perspective of the pulp mill of FIGS. 1 and 2 in somewhat enhanced detail and with the roof and outer wall omitted.

A pulp mill constructed in accordance with the teachings of the present invention is illustrated, by way of example, in FIGS. 1, 2 and 3. FIG. 1 is a somewhat diagrammatic top plan view of the mill taken along a section cut just below the mill roof, while FIG. 2 is an elevated perspective view of the same mill as seen from the outside thereof. FIG. 3 depicts such a pulp mill, and most especially many of the various processing and production stations or sections thereof, in enhanced or additional detail from an elevated perspective and with the outer wall and roof omitted for convenience of illustration and to facilitate the following description.

Thus, and with particular reference to FIGS. 1 to 3, the illustrated pulp mill of the invention is generally bounded by a substantially circular outer wall 1 and includes a centrally-disposed main control room or station 2. The various processing or production stations or sections of the mill—through which pulp moves or is moved or transported as it is converted from whole logs or wood chips to, for example, bleached high consistency pulp or dried pulp bales—are disposed radially outwardly from and about the central control room 2 so as to define the sectors of a wholly or partly or primarily circular or annular form or the like. Moreover, in further accordance with the invention, the arrangement of these multiple processing stations in a circumferential manner about the main control room 2 is most preferably such that stations at which successive processing or storage or other operations are carried out on the chips or pulp or the like are located immediately adjacent one another so that the flow of pulp through the mill, as it proceeds from the beginning to the end of the entire mill process, is generally progressively circumferential about and with respect to the control room 2.

The drawings—and particularly FIG. 1—are intended to show primarily, for ease of illustration and description, the major and most significant or fundamental processing sections or stations of a pulp mill. It should accordingly be understood and appreciated, and will be evident to those skilled in the art, that it is both anticipated and expected that a pulp mill constructed in accordance with the present invention may further include additional elements and processing stations to those particular stations that are expressly illustrated and/or described herein. The inclusion of such additional elements and processing stations is thus within the intended scope and contemplation of the invention.

Returning then to the drawings the pulp mill includes, within its peripheral outer or side wall 1 and proceeding generally clockwise (in FIG. 1) about the main control room 2, a processing station or section 3 for the manufacture, storage and application of chemicals used in the pulp process, a water treatment section 4, a main liquor storage section 5, a lime kiln 6, and an evaporation and pre-evaporation plant or section 8. An enclosed housing part 21 that extends, at least in part, unitarily upward and radially-outward from the main generally circular mill structure that is circumferentially bounded by the outer wall 1 encloses a pulp cooking department or section 7 and a recovery boiler 9; a ventilation stack 22 that is associated therewith may be located proximately outward of the wall 1. Continuing in a substantially clockwise sense, the mill further includes within its main, generally circular structure a turbine house or station 10, a chip feeding station 11, an effluent treatment section 12, a bleaching section 13, a storage section 14 for high consistency pulp, and a dryer section 15. A bale storage area 16 is located immediately outside of and extending from the circumferential outer wall 1 adjacent the dryer section 15 for receiving and holding, for example, the processed, dried pulp. The generally circular pulp mill structure or building is unitarily covered by a roof 19 to substantially fully enclose the mill, in conjunction with the outer wall 1, and thereby shield from the weather and outside environment all or virtually all of the multiple processing sections or stations that combinationally form the pulp mill in accordance with the present invention.

It should also be pointed out and noted that such a pulp mill preferably further includes a system for enabling the ready and selective conveyance of pulp and other materials—including the products, subproducts and byproducts produced in or resulting from the processing of pulp—to and between the various processing stations or sections of the mill. Toward this end, a conventional or other crane system or the like may be provided and, by way of example, such a crane may be arranged for movement along railway-type tracks 17 or the like which extend along at least a diameter of the mill. The mill will also generally and conventionally require or include transportation lines or paths 18, such for example as the illustrated railway tracks and leveled lanes or paths, to enable suitable access by railroad and other transport vehicles for the delivery of raw materials to and the transport of processed pulp and other byproducts and materials from the mill. The railroad access tracks may also, optionally and for operating convenience, tie into the crane system track(s) 17 to permit their dual use and thereby increase the flexibility of both transport and conveyance operations.

Another advantageous aspect and feature of the present invention is the provision of a novel integrated manner of collecting and treating odorous gases and other waste or contaminated materials or products or byproducts that are produced or otherwise result from, for example, the use of chemicals and raw materials and the processing of wood chips or pulp in the mill. By virtue of the inventive arrangement for integrated collection and treatment of substantially all such waste and contaminated materials and the like, the final sulphate or other pulp product may be produced and processed in a substantially non-polluting manner while providing for mill personnel a properly ventilated and environmentally safe working environment that permits realization of significantly improved work efficiency and increased worker satisfaction.

An integrated system in accordance with the present invention for collecting and treating the odorous gases that are produced in the operation of, by way of example, a sulphate pulp mill is depicted in the flow chart of FIG. 4. The various gases so produced, collected and treated are, for convenience, separated into four general types or classes which are delineated "A", "B", "C" and "D" and depicted at the various block sections of FIG. 4 by the appropriate circled letters. The "A" class gases are strong combustible odorous gases, the "B" class gases are mild combustible odorous gases, the "C" class gases are strong incombustible odorous gases, and the "D" class gases are mild incombustible odorous gases. The strong odorous class "A" and "C" gases generally have a pH in the range of approximately 7 to 9 and a temperature of approximately 40 to 90 degrees centigrade; the mild odorous class "B" and "D" gases generally have a pH in the range of approximately 6 to 9 and a temperature of approximately 5 to 50 degrees centigrade. In accordance with the present invention, disposal efficiency of the class "A" and "C" gases is preferably at least approximately 99 percent, and disposal efficiency of class "B" and "D" gases is preferably in the range of approximately 50 to 100 percent.

Although it is believed that the integrated arrangement and process of collecting and treating odorous gases in accordance with the invention will be apparent to those skilled in the art from the block diagram depiction of FIG. 4, the following description is provided to further enhance and elucidate the instant disclosure thereof. First, with respect to the mild gases of classes "B" and "D", the "D" class gases from the green, white and weak black liquor tanks 23 are conveyed for combustion to and in the lime kiln 24 together with the class "D" gases from the causticizing silo, the slaker and the causticizing tank (collectively indicated at 25). The flue gases from the lime kiln 24 are purified or cleansed, prior to release to the environment, in an electric filter 26 and a flue gas scrubber 27.

Of the mild class "B" gases, those recovered from the tanks of the evaporation plant 28 are communicated to and for combustion in an auxiliary boiler 29. The flue gases from the auxiliary boiler 29 are, as for the lime kiln 24, purified in an electric filter and flue gas scrubber before being released to the environment.

The class "D" gases from the reaction and filtration tanks in the bleaching plant 30 are conveyed to an alkaline solution washer 31 of the chlorine dioxide plant prior to combustion in the recovery boiler 33. Class "D" general removal gases 34 from the chemical preparation plant 35 are also conveyed, together with washed class "C" gases from the plant 35, to the recovery boiler 33 for combustion therein. The flue gases from the recovery boiler 33 are, as with the lime kiln 24 and auxiliary boiler 29, purified in an electric filter and flue gas scrubber prior to their release to the environment Secondary water treatment 36—as in pressure filters, deep aeration stages, lamella clarifier, flotator and screw press—produces class "B" gases that are communicated to and for combustion in the recovery boiler 33. The thickeners 37 and sorters 38 produce class "D" gases that are likewise conveyed to the recovery boiler 33. Chip treatment processing 39—i.e. the vibrating screen, chip silos and knot silos—and digesting 40 yield class "B" gases that are also combusted in the recovery boiler 33.

With respect now to the odorous gases of classes "A" and "C", the class "A" gases from the pre-evaporation plant 41 and from the evaporation plant 28 are communicated for combustion to the auxiliary boiler 29. The processing of class "A" gases is air-tight so that the gases will not dilute under the upper level of explosion. The recovery boiler 33 also serves as a spare combustion site for the class "A" gases. The non-condensed Class "A" stripping gases from the pre-evaporation plant 41, which gases contain methanol, are similarly conveyed to the auxiliary boiler 29, as are the class "C" gases from the pre-evaporation plant 41 and the oxygen delignification apparatus 42, for combustion in the boiler.

The "C" class gases resulting from the production of chlorine dioxide (block 32) are communicated to the washer 31 wherein they are washed with an alkaline solution. Likewise, the class "C" gases from the chemical manufacture tanks 35 are washed at 31 with an alkaline solution. The washed gases are then conveyed to, for combustion in, the recovery boiler 33.

Thus, in accordance with this advantageous feature of the present invention, all odorous gases that are produced during or otherwise associated with the pulp processing operations of a pulp mill are collected and treated in an integrated and controlled manner so as to minimize or substantially eliminate environmental pollution from the mill.

There has accordingly been disclosed a novel and unusually advantageous arrangement for a pulp mill in which the wood chips or pulp being processed is generally serially passed from station to station, at each of which respective parts or aspects of treatment or storage steps of the overall pulping process take place. A main control room is substantially centrally-disposed with respect to the various processing stations which are arranged radially-outward of the control room in the manner of the sectors of a wheel or disk (or portion thereof) or the like, all or virtually all such stations being arranged within a single building or structure or otherwise under a single, integrally-extending roof. In addition, the various individual processing stations are themselves disposed or ordered so that the flow of the pulp or other material(s) being processed proceeds generally circumferentially about the centrally-situated main control room. This arrangement, inter alia, facilitates direct monitoring of the various processing stations from the centralized control room, reduces the distance that material must travel or be transported or conveyed between stations, decreases energy consumption and costs, permits more rapid dynamic adjustment of ongoing process parameters and the like, enables maintenance procedures to be more rapidly and more easily carded out, reduces water consumption, increases overall reliability of the mill, and reduces design, planning and construction time, as well as construction costs, as compared to current or prior art pulp mill layouts and arrangements—in which each or most of the various individual processing stations or sections are typically located in respectively separate buildings or structures situated off of the main processing line. The present invention further provides the ability, and disclosed an arrangement, for integrated and centralized control of the collection and treatment of waste water, solid wastes and, most notably, of air and odorous gases from the entire mill.

While there have been shown and described and pointed out fundamental novel features of the invention as applied to a preferred embodiment thereof, it will be understood that various omissions and substitutions and changes in the form and details of the embodiments illustrated and described may be made by those skilled in the art without departing from the spirit of the invention. It is the intention, therefore, to be limited only as indicated by the scope of the claims appended hereto.

What is claimed is:

1. A mill for the processing and production of wood pulp, comprising:

a single, integral structure defining a unitarily-covered space substantially bounding and enclosing the mill;

a main control station for overall monitoring and control of pulp processing operations in the mill, said control station being disposed substantially centrally within said covered space; and a plurality of processing stations at which various respective pulp processing operations substantially sequentially take place, said plural processing stations being disposed within said covered space and radially outwardly from said main control station, individual ones of said processing stations being arranged and located in said space relative to others of said processing stations so that as the pulp undergoes said sequential processing operations at said plural processing stations the pulp proceeds substantially circumferentially about said main control station between and among said individual processing stations in said unitarily-covered space.

2. A pulp mill in accordance with claim 1, said structure comprising a substantially continuous outer wall forming a circumferentially arcuate boundary of said covered space.

3. A pulp mill in accordance with claim 1, said structure comprising an outer wall bounding and defining a substantially circular circumferential periphery of said covered space.

4. A pulp mill in accordance with claim 1, said plural processing stations comprising a station for production of chemicals, a water treatment station, a main liquor storage section, a lime kiln, a pulp cooking station, an evaporation plant, a recovery boiler, a turbine section, a chip feeding station, an effluent treatment section, a bleaching section, a high consistency pulp storage section, and a dryer section.

5. A pulp mill in accordance with claim 1, further comprising pulp conveyance means in said covered space operable for selectively conveying pulp to and between said individual processing stations of said pulp mill.

6. A pulp mill in accordance with claim 5, wherein said pulp conveyance means comprises a crane system.

7. A pulp mill in accordance with claim 5, said pulp conveyance means being disposed on diametrically-opposite sides of said main control station.

8. A pulp mill in accordance with claim 1, further comprising means for integrated and centralized control and treatment of atmospheric emissions from said mill.

9. A pulp mill in accordance with claim 1, further comprising means for integrated and centralized treatment of process liquors produced in said pulp processing operations.

10. A pulp mill in accordance with claim 1, further comprising means for centralized treatment of waste materials produced in said pulp processing operations.

11. A pulp mill in accordance with claim 1, further comprising means for centralized control and treatment of mill effluents for discharge to waters.

12. A pulp mill in accordance with claim 1, further comprising means for centralized treatment of air in the mill.

13. A pulp mill in accordance with claim 1, further comprising means for centralized and integrated treatment of all odorous gases produced in said pulp processing operations.

14. A pulp mill in accordance with claim 1, further comprising a partition wall separating at least one of said individual processing stations from an immediately-adjacent other one of said processing stations.

15. A pulp mill in accordance with claim 1, further comprising means located at least partly within said covered space for enabling access to the mill by transport vehicles for transporting materials into and out of the mill.

16. A pulp mill in accordance with claim 15, said access enabling means comprising railroad tracks.

17. A method of constructing a pulp mill, comprising the steps of:

constructing a single, integral structure defining a unitarily-covered space substantially bounding and enclosing the mill;

locating a main control station, for overall monitoring and control of pulp processing operations in the mill, substantially centrally within said covered space; and locating a plurality of processing stations, at which various respective pulp processing operations substantially sequentially take place, within said covered space and radially outwardly from the main control station, said step of locating the plurality of processing stations further comprising locating individual ones of the plural processing stations relative to others of the processing stations such that as the pulp undergoes said sequential processing operations at the plural processing stations the pulp proceeds substantially circumferentially about the main control station between and among the individual processing stations in the unitarily-covered space.

* * * * *